US006524120B2

(12) United States Patent
Zhao

(10) Patent No.: US 6,524,120 B2
(45) Date of Patent: Feb. 25, 2003

(54) ARTICLE COMPRISING EMI SHIELDING

(75) Inventor: Haixiong Zhao, Holmdel, NJ (US)

(73) Assignee: Mobicom Corp., Holmdel, NJ (US)

( * ) Notice: Subject to any disclaimer, the term of this patent is extended or adjusted under 35 U.S.C. 154(b) by 0 days.

(21) Appl. No.: 09/814,529

(22) Filed: Mar. 22, 2001

(65) Prior Publication Data

US 2002/0137371 A1 Sep. 26, 2002

(51) Int. Cl.[7] ..... H01R 13/648
(52) U.S. Cl. ..... 439/95; 439/607; 361/816
(58) Field of Search ..... 439/92, 95, 607; 361/816, 818

(56) References Cited

U.S. PATENT DOCUMENTS 4,404,617 A * 9/1983 Ohyama et al. ..... 174/35 R
4,841,414 A * 6/1989 Hibino et al. ..... 334/85
5,748,455 A * 5/1998 Phillips et al. ..... 174/35 R
6,256,199 B1 * 7/2001 Yusuf et al. ..... 165/185

* cited by examiner

*Primary Examiner*—Gary Paumen
*Assistant Examiner*—James R. Harvey
(74) *Attorney, Agent, or Firm*—DeMont & Breyer, LLC

(57) ABSTRACT

EMI shielding at the PCB level comprises, in one embodiment, a box that is open at one side. The box is formed from a material that is substantially opaque to EMI in at least the operating frequency range of the electronic components being shielded. The open side of the box is surrounded by a lip. In use, the EMI shielding is typically received by a housing, and the lip overlies ribs or walls that segment the housing. Such ribs are aligned for contact with a ground track of a PCB. When the PCB is attached to the housing, the lip of the EMI shielding is pressed against the ground track, making electrical connection therewith. The lips are advantageously physically adapted to provide a resilience. In one embodiment, the resilience is imparted by a bend that is used to form the lip. Such resilience promotes reliable electric contact between the lip and the ground track of the PCB. In further embodiments, the lip of each wall is further deformed (e.g., bent, cut, etc.) to provide additional functionality (e.g., a channel for receiving ribs of the housing) or to impart resiliency by way of a plurality of small spring members.

3 Claims, 5 Drawing Sheets

ARTICLE COMPRISING EMI SHIELDING

FIELD OF THE INVENTION

The present invention relates generally to electromagnetic interference ("EMI") and more particularly to shielding electronic components from EMI and radio frequency interference ("RFI").

BACKGROUND OF THE INVENTION

The acronym "EMI" refers, typically, to unwanted electrical "noise" that leaks, in the form of magnetic fields, from a power-carrying line. Noise signals that act over a substantial distance are usually referred to as RFI. EMI/RFI (hereinafter simply "EMI") may adversely affect the functioning of electronic equipment. The levels of EMI reaching such electronic equipment must therefore be reduced to benign levels.

Typical EMI countermeasures include a combination of filtering, for conducted EMI (i.e., noise transmitted through wires), and shielding, for radiated EMI. To provide maximum protection for radiated EMI, shielding methods are implemented at more than one "assembly" level. For example, shielding may be provided at the component level, the printed circuit board ("PCB") level, the shelf level or the cabinet level, or a combination thereof as appropriate.

Shielding may be particularly important or critical at one specific assembly level as a function of the electronic device being considered. For example, PCB-level shielding is particularly important for wireless terminals (e.g., cellular telephones, cordless telephones, cellular modems, etc.).

In the context of wireless terminals, PCB-level shielding arrangements/methods that are known in the prior art fall into one of several categories. Those categories include:

(1) permanently PCB-mounted metal shielding "cans;"

(2) permanently PCB-mounted metal wall (fence) with removable clip-on cap;

(3) removable plastic (conductor-coated or plated) shielding cans with or without conductive elastomeric gasket;

(4) removable metal cans with weld-on spring metal gasket strip; and (5) housing-integrated shielding wherein inner surface of housing is conductor-coated and gasket is applied to edge of walls in contact with the ground track on the PCB.

While shielding solutions selected from these categories are expected to be effective at rejecting EMI, they all suffer from a variety of drawbacks. In particular, shielding falling into categories (1) and (2) suffer from air/heat flow problems that create difficulties in heating solder, thereby preventing the use of surface mounted chips. Moreover, shielding from categories (1) and (2) may have limitations pertaining to the size of the shielding, the co-planarity of the metal "can," and test and repair requirements.

Using removable shielding, as is embodied by shielding from categories 3–5, eliminates air/heat flow problems and is desirable for PCB testing and repair. Such shielding suffers, nevertheless, from other drawbacks. Specifically, shielding falling into categories 3 and 5 is expensive, requires a relatively large ground track width on the PCB, requires a specialized vendor to produce quality parts and uses materials/processing steps that raise environmental concerns. And shielding from category (4) requires a wide ground track, has a requirement that there be no internal section walls, and requires expensive welding techniques (i.e., to weld the tiny metal spring strip to the shielding can).

Notwithstanding the variety of shielding options available, a need therefore exists for improved PCB-level shielding.

SUMMARY OF THE INVENTION

The present invention provides PCB-level EMI shielding that avoids many of the drawbacks of the prior art. In particular, the present shielding is easy to manufacture, easy to install, easy to remove, is capable of shielding separate chambers, has a small form factor and is low in cost.

In one embodiment in accordance with the present teachings, the EMI shielding comprises a "can," "box" or "partial enclosure" that is open on one side. The can has a substantially flat planar base and walls that depend from the edges of the base. The can is formed from a material that is substantially opaque to EMI in at least the operating frequency range of the electronic components being shielded.

In some embodiments, the distal end of each wall (i.e., distal relative to the base) is bent toward the outside of the can thereby forming a "lip" on each wall. Such lips collectively form a gasket-like member at the open end of the can. When the can is in use, the gasket-like member contacts a grounding element on a PCB, such as, for example, a ground track. In a typical application, the present shielding is disposed within an electronic device sandwiched between the PCB and a housing.

For PCBs requiring multiple shielding zones, a like number of the present shielding cans are suitably fabricated. To the extent that the device housing is compartmentalized to facilitate such multiple shielding zones, the present cans are advantageously preformed to fit into such compartments.

The gasket-like member at the open end of the can is advantageously physically adapted to provide a resilience or "springiness." In one embodiment, the resilience is imparted by the bend that is used to form the lip for each wall. Consequently, when the can is sandwiched in position between a PCB board on one side and a housing on another side, the resilience of the gasket-like member facilitates reliable electric contact between the can and the grounding element of the PCB. In further embodiments, the lip of each wall is further deformed (e.g., bent, cut, etc.) to provide additional functionality (e.g., a channel for receiving ribs of the housing) or for further improving conformance of the lip to the ground track (e.g., a plurality of spring members formed within the lip).

DETAILED DESCRIPTION

While the illustrative embodiments described herein are directed to PCB-level EMI shielding for wireless terminals, it will be recognized that the present shielding is broadly applicable to a wide variety of electronic devices at the PCB level.

Figure 1:
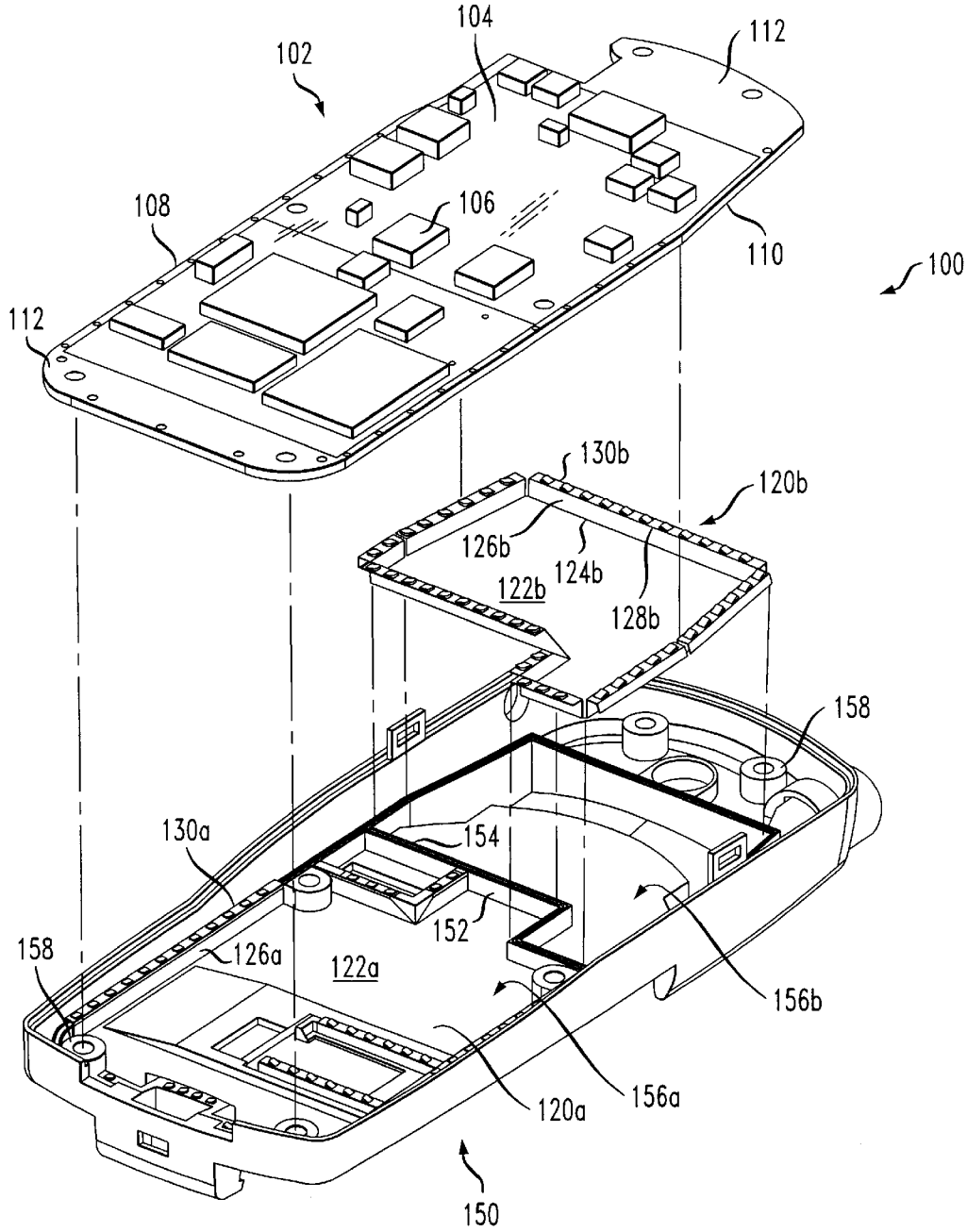
FIG. 1 depicts an exploded view of an improved wireless terminal in accordance with the present teachings incorporating two EMI shielding cans.

FIG. 1 depicts an exploded view of illustrative wireless terminal 100 in accordance with the present teachings. Wireless terminal 100 includes doubled-sided PCB 102, EMI shielding 120*a* and 120*b*, and housing 150, related as shown.

PCB 102 includes, on first side 104, electrical components 106 and ground track 108. Second side 110, obscured in FIG. 1, includes the same features (i.e., electrical components 106 and ground track 108) but arranged in a different layout. Holes 112 facilitate attaching housing PCB 102 to housing 150.

Illustrative EMI shielding 120*b* includes flat planar base 122*b* and walls 126*b* that depend from edges 124*b* of the base 122*b*. Base 122*b* and walls 126*b* collectively define a "box," "can" or "partial enclosure" that is open on the side opposite to base 122. EMI shielding 120*a* is configured in the same manner. See also FIG. 2., wherein the illustrative embodiment of the EMI shielding is enlarged for clarity. When wireless terminal 100 is assembled, the opening in EMI shielding 120*a* and 120*b* receives electrical components 106 that are disposed on second side 110 of PCB 102.

Illustrative EMI shielding 120*b* (and 120*a*) also includes lip 130*b* (130*a*) that is defined, at least in part, by bend 128*b* (128*a*) in each wall 126*b* (126*a*). Lip 130*b* (130*a*) on each wall 126*b* (126*a*) collectively forms a gasket-like member.

Figure 2:
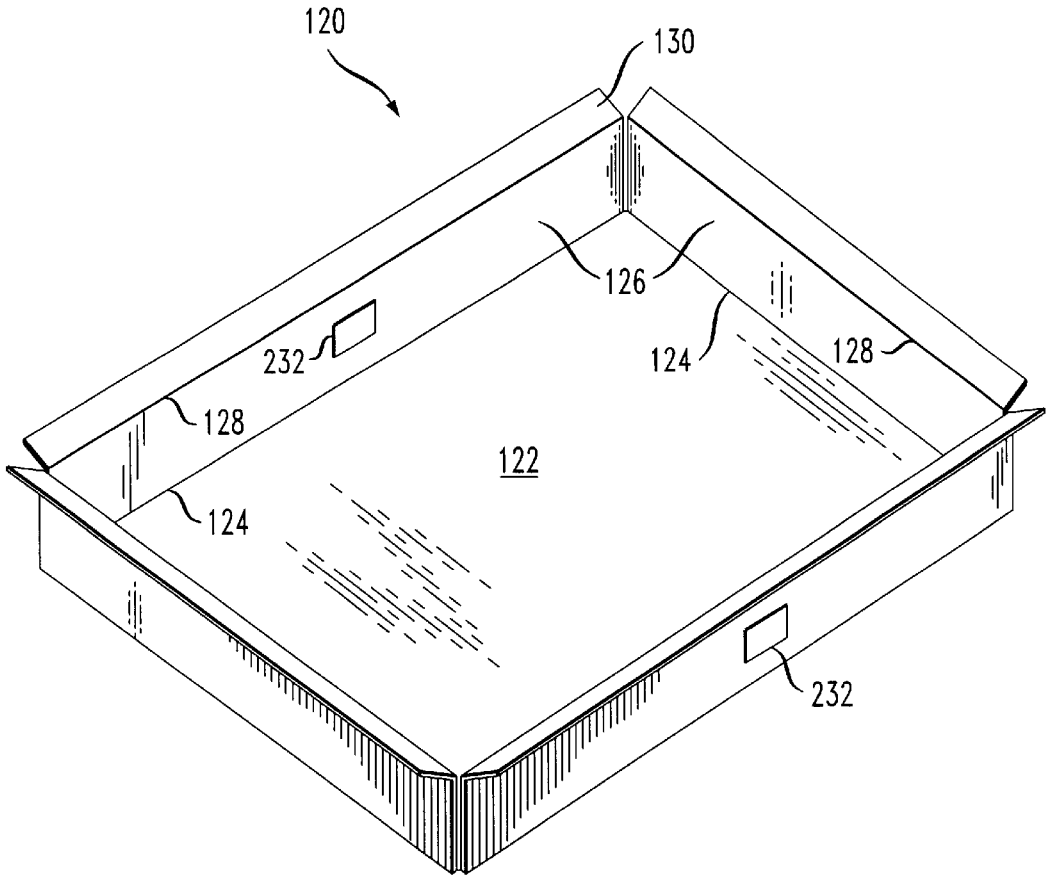
FIG. 2 depicts an illustrative embodiment of an EMI shielding can in accordance with the present teachings.

In some embodiments, lip 130 is advantageously integral with wall 126. The term "integral" is defined for use herein as follows: a feature/element (e.g., lip 130) is said to be "integral" with another feature/element (e.g., wall 126) when both such elements are continuous with one another in that they are formed from a single element (e.g., a piece of material that is bent near one end to form a lip). Note that lip 130 depicted in FIG. 2 is configured somewhat differently than lip 130*b* (130*a*) of FIG. 1. Several different embodiments of lip 130, which is an important element of the present invention, are described in further detail later in this
Specification.

EMI shielding 120*a* and 120*b* comprise a material(s) that is capable of significantly attenuating radiated EMI in at least the operating frequency range of electronic components 106 being shielded. In other words, the shielding material is substantially opaque to radiated EMI in the operating frequency range of interest. The shielding material can be, for example, a metal.

Housing 150 includes internal walls or ribs 152 that, among any other purposes, define various chambers or compartments 156 within the housing. The present EMI shielding is suitably fabricated (i.e., has an appropriate shape and appropriate dimensions) to be received by such compartments. In the illustrative embodiment of FIG. 1, EMI shielding 120*a* is received by compartment 156*a* and EMI shielding 120*b*, which is shown in exploded relation to housing 150 for clarity of illustration, is positioned to be received by compartment 156*b*.

Figure 3:
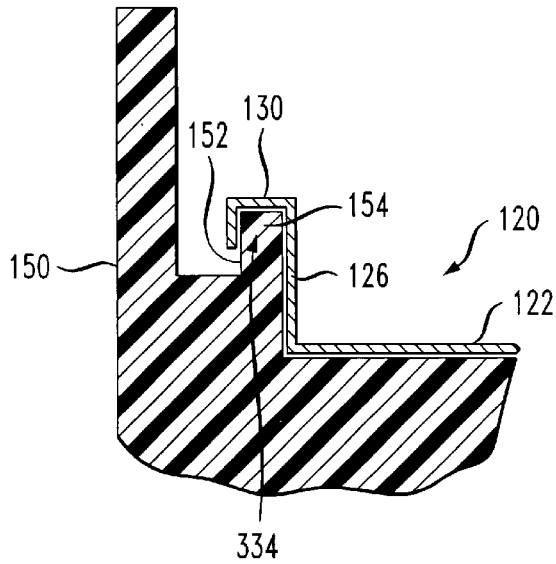
FIG. 3 depicts a side view of an illustrative EMI shielding can engaged to a housing.

When EMI shielding, such as EMI shielding 120*a*, is positioned within compartment 156*a*, lips 130*a* overlay top 154 of ribs 152. In the embodiment depicted in FIG. 1, lip 130*a* forms a channel that receives the uppermost portion (i.e., including top 154) of each rib 152. FIG. 3 depicts a cross sectional view showing EMI shielding 120 received by housing 150 and lip 130 defining channel 334 that receives uppermost portion of rib 152. See also, FIGS. 4, 7 and 8. Channel 334, which is a feature of some embodiments of lip 130, assists in maintaining the position of EMI shielding 120 once disposed in housing 150 and in keeping lip 130 over rib 152.

In some embodiments, EMI shielding 120 comprises one or more openings 232, two of which are depicted in FIG. 2. Such openings 232 are configured to mate with a tab or other protrusion (not shown) that depends from the side of rib 152. Like channel 334, openings 232 aid in keeping EMI shielding 120 from movement within housing 150.

When PCB 102 and housing 150 are mated, ground track 108 on second surface 110 of PCB 102 aligns with and abuts lips 130*a* and 130*b* of respective EMI shielding 120*a* and 120*b*. Screws (not shown) are passed through holes 112 in PCB 102 and are threaded into receivers 158 in housing 150. As the screws are tightened, lips 130*a* and 130*b* are pressed against ground track 108 on second side 110 of PCB 102.

Figure 4:
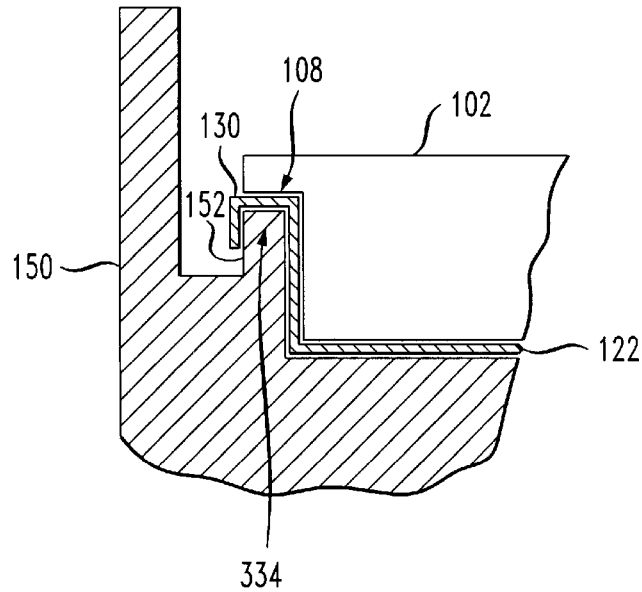
FIG. 4 depicts a side view of an illustrative EMI shielding can engaged to a housing and in electrical contact with a PCB.

FIG. 4 depicts a cross sectional view showing housing 150 and PCB 102 sandwiching EMI shielding 120. FIG. 4 shows "lower" surface of lip 130 receiving uppermost portion of rib 152 and ground track 108 of second surface 110 of PCB 102 contacting "upper" surface of lip 130.

Lips 130*a* collectively form a gasket that, in conjunction with base 122*a* and walls 126*a* of EMI shielding 120*a*, isolates a first group of electronic components 106 (not visible since such components are located on second side 110) from radiated EMI. Similarly, lips 130*b* collectively form a gasket that, in conjunction with base 122*b* and walls 126*b* of EMI shielding 120*b*, isolates a second group of electronic components 106 (also not visible) from radiated EMI.

As previously stated, lips 130 are an important aspect of the present invention. FIGS. 5–8 depict several illustrative embodiments of lips 130.

Figure 5:
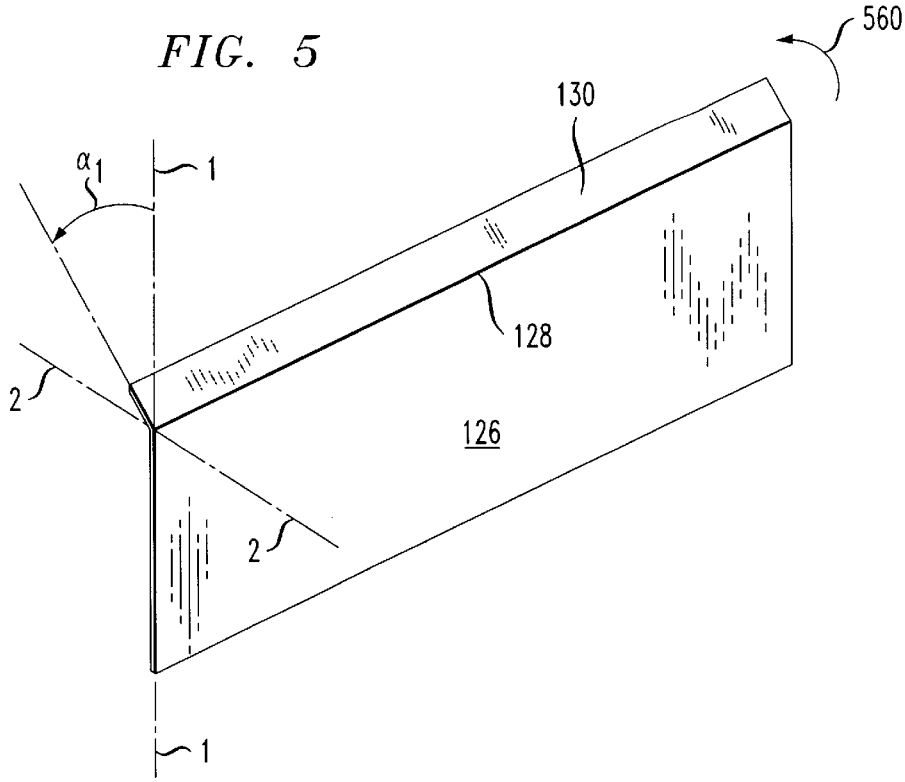
FIG. 5 depicts detail of a lip of the illustrative EMI shielding can depicted in FIG. 2.

FIG. 5 depicts a very basic embodiment of lip 130. In the embodiment depicted in FIG. 5, lip 130 is created by forming bend 128 in wall 126. In particular, lip 130 is formed by bending the marginal portion of wall 126 "away" from the opening of the can along the direction 560. See also FIG. 2. In other words, the marginal portion of wall 126 is bent, at bend 128, away from axis 1—1 and toward axis 2—2.

Bend 128 imparts a resilience to lip 130 in that, as lip 130 is forced further downwardly (i.e., toward axis 2—2) such as when PCB 102 is tightened against housing 150, lip 130 resists such downward movement. Such resilience promotes conformance of lip 130 to ground track 108. Such conformance ensures reliable electrical contact between lip 130 and ground track 108 as is required for effective shielding against radiated EMI.

It will be appreciated that the angle $\alpha_1$, by which lip 130 is bent away from axis 1—1 must be less than ninety degrees to impart resilience to lip 130. In fact, as angle $\alpha_1$ increases toward ninety degrees, the imparted resilience decreases. But, angle $\alpha_1$ should not be too shallow or lip 130 may deform as PCB 102 is engaged to housing 150. The value of angle $\alpha_1$ is advantageously in a range of about thirty degrees to seventy-five degrees.

Figure 6:
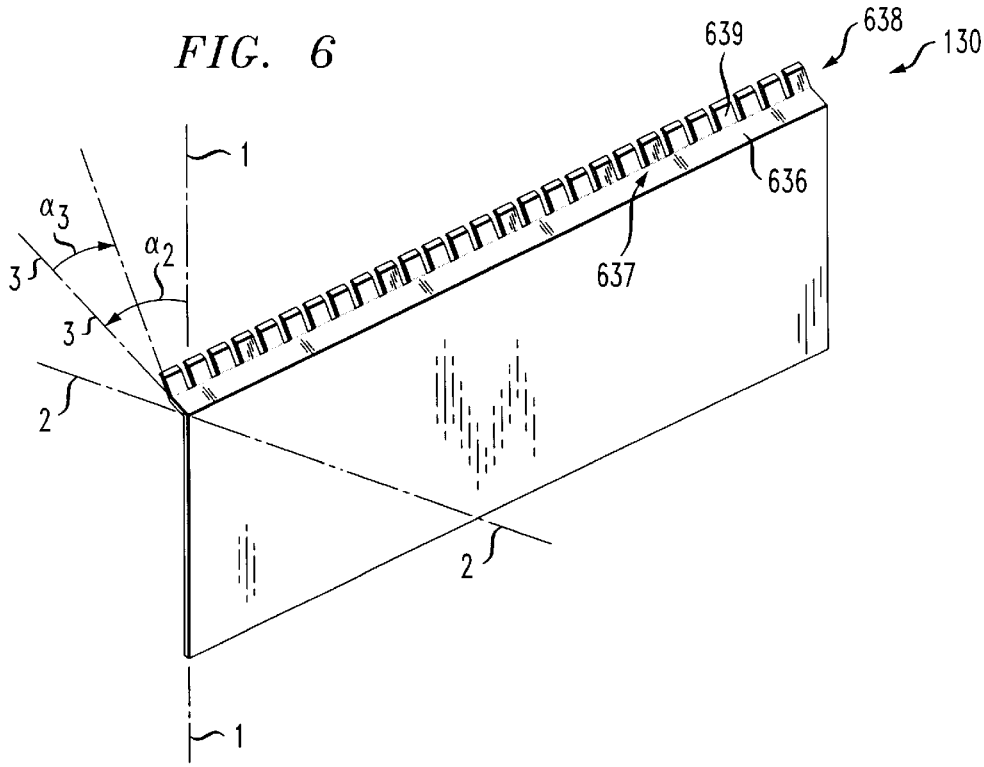
FIG. 6 depicts a second illustrative embodiment of a lip for use with the present EMI shielding can.

FIG. 6 depicts a second illustrative embodiment of lip 130. In the embodiment depicted in FIG. 6, lip 130 comprises first portion 636 and second portion 638. The two portions are created by additional bend 637 in lip 130.

First portion 636 of lip 130 is bent away from axis 1—1 by an angle $\alpha_2$, and second portion 638 of lip 130 is bent back toward axis 1—1 (i.e., away from axis 3—3) by an angle $\alpha_3$. Second portion 638 of lip 130 comprises a plurality of spring members 639. Plural spring members 639 improve conformance between lip 130 and ground track 108 by providing a measure of micro-adjustability relative to continuous lip 130 of FIG. 5. Angle $\alpha_2$ is advantageously in a range of about sixty to eighty degrees (away from axis 1—1) and angle $\alpha_3$ is advantageously in a range of about ten to thirty degrees (away from axis 3—3 toward axis 1—1).

Figure 7:
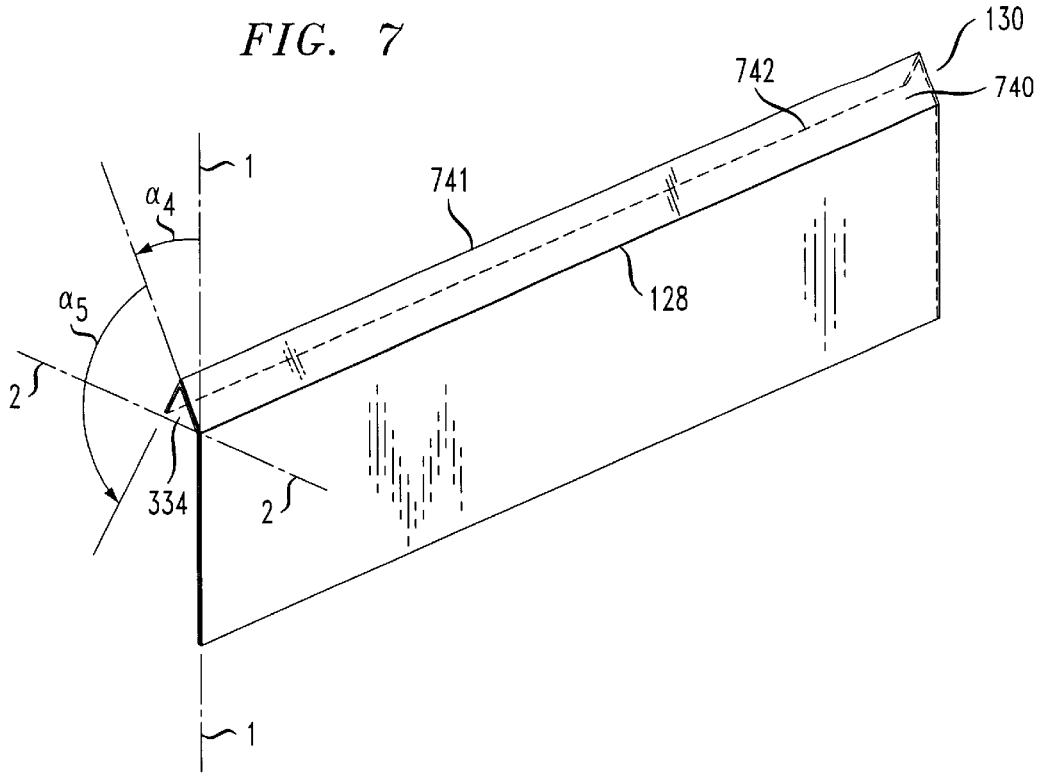
FIG. 7 depicts a third illustrative embodiment of a lip for use with the present EMI shielding can.

FIG. 7 depicts a third illustrative embodiment of lip 130. Bend 128 imparts resilience to lip 130, as in the embodiment depicted in FIG. 5. The value of angle $\alpha_4$ is advantageously in a range of about thirty degrees to seventy-five degrees.

Additional bend 741 segregates lip 130 in two portions 740 and 742 thereby creating channel 334 (see previous description) that receives top portion of ribs 152 of housing 150. Portions 742 and 740 are advantageously substantially perpendicular to one another (i.e., $\alpha_5$ is about ninety degrees).

Figure 8:
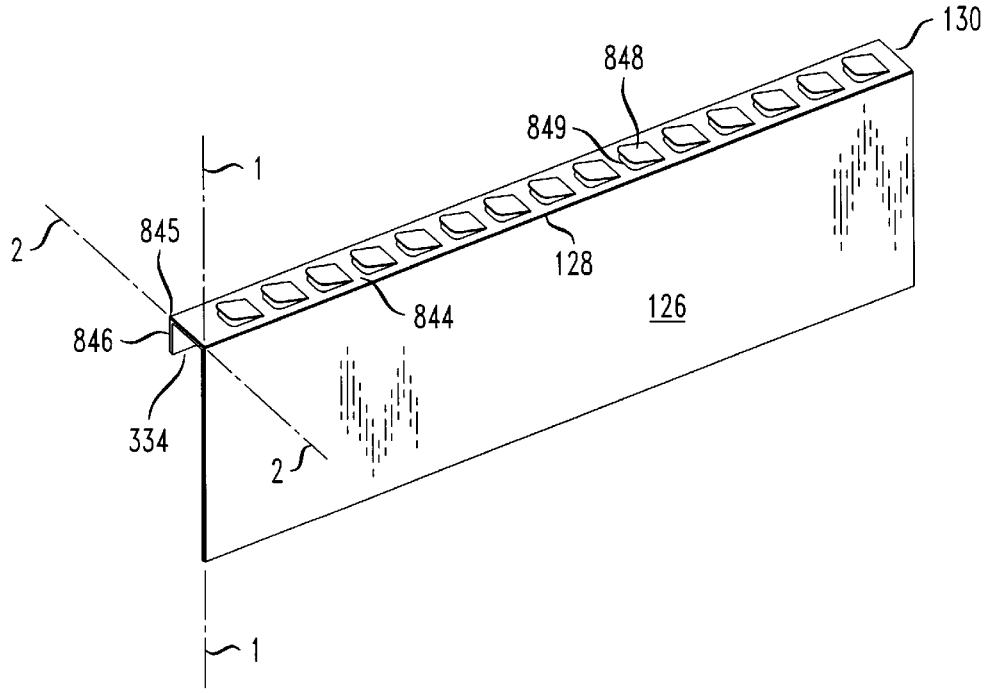
FIG. 8 depicts a fourth illustrative embodiment of a lip for use with the present EMI shielding can.

A fourth illustrative embodiment of lip 130 is depicted in FIG. 8. (See also FIG. 1). Bend 845 segregates lip 130 into first portion 844 and second portion 846. Primary bend 128 creates lip 130, although no resilience is imparted thereto since first portion 844 is bent ninety degrees away from axis 1—1. Second portion 846 is substantially perpendicular to first portion 844 and substantially parallel to wall 126. As in the embodiment depicted in FIG. 7, lip 130 defines channel 334 for receiving the upper portion of ribs 152 of housing 150.

Lip 130 also comprises spring members 848, which are small cantilevered sections that are advantageously stamped out of first portion 844. Spring members 848 are bent upwardly relative to first portion 844 of lip 130. The bend imparts resilience to spring members 848. Like the embodiment depicted in FIG. 7, the multiplicity of spring members 848 facilitate conformance between lip 130 and ground track 108 thereby promoting reliable electrical contact therebetween.

The stamping and bending operations that are required for forming the various embodiments of lip 130 are routine in the art and easy to implement. Such bending and stamping operations are preferable to the soldering, welding, coating/painting/plating and curing operations that are used, in various prior art processes, to form EMI shielding.

It is to be understood that the above-described embodiments are merely illustrative of the invention and that many variations may be devised by those skilled in the art without departing from the scope of the invention and from the principles disclosed herein. It is therefore intended that such variations be included within the scope of the following claims and their equivalents.

I claim:

1. A wireless terminal comprising:

a printed circuit board having a ground track;

a housing having internal partitions, wherein said internal partitions define at least a first chamber and a second chamber within said housing;

a first electromagnetic interference ("EMI") shield and a second EMI shield, wherein each of said EMI shields comprises:

a base;

walls that depend from edges of said base;

a lip depending from each of said walls; and a plurality of resilient spring members defined in each said lip, wherein said spring members facilitate electrical contact between said electromagnetic interference shield and said ground track; wherein:

said lip of said first EMI shield is physically configured to receive a top portion of said internal partitions that define said first chamber;

said lip of said second EMI shield is physically configured to receive a top portion of said internal partitions that define said first chamber;

said base, walls, lip and spring members of each said EMI shield comprises a material suitable for attenuating electromagnetic interference; and said lip and said plurality of resilient spring members of each said EMI shield are sandwiched between said ground track of said printed circuit board and said top portion of said internal partitions.

2. The wireless terminal of claim 1 wherein:

said lip of said first EMI shield defines a channel, wherein said channel receives said top portion of said internal partitions that define said first chamber; and said lip of said second EMI shield defines a channel, wherein said channel receives said top portion of said internal partitions that define said second chamber.

3. The wireless terminal of claim 1 wherein said base, walls, lip and spring members of said first EMI shield and said second EMI shield comprise metal.

* * * * *